US010545011B1

(12) United States Patent
Collins

(10) Patent No.: US 10,545,011 B1
(45) Date of Patent: Jan. 28, 2020

(54) TARGET DISK THROWING SYSTEM

(71) Applicant: Michael Collins, Blanchard, OK (US)

(72) Inventor: Michael Collins, Blanchard, OK (US)

(73) Assignee: Subshot, LLC, Blanchard, OK (US)

( * ) Notice: Subject to any disclaimer, the term of this patent is extended or adjusted under 35 U.S.C. 154(b) by 0 days.

(21) Appl. No.: 16/279,264

(22) Filed: Feb. 19, 2019

(51) Int. Cl.
*F41J 9/18* (2006.01)
*F41J 9/24* (2006.01)
*F41J 9/32* (2006.01)

(52) U.S. Cl.
CPC . *F41J 9/24* (2013.01); *F41J 9/18* (2013.01); *F41J 9/32* (2013.01)

(58) Field of Classification Search
CPC .. F41J 9/18; F41J 9/20; F41J 9/24; F41J 9/32
USPC ..... 124/6–9
See application file for complete search history.

(56) References Cited

U.S. PATENT DOCUMENTS 2,135,603 A * 11/1938 Roth ..... F41J 9/20 124/8
3,420,218 A * 1/1969 Rademacher ..... F41J 9/20 124/7
4,005,695 A * 2/1977 Alday ..... F41J 9/30 124/8
4,220,130 A * 9/1980 Glover ..... A63B 69/408 124/36
4,481,932 A * 11/1984 Olson ..... F41J 9/20 124/43
4,699,116 A * 10/1987 Freeland ..... F41J 9/18 124/32
4,967,720 A * 11/1990 McCord ..... F41J 9/30 124/47
5,226,622 A * 7/1993 LeAnna ..... F16M 11/08 124/8
6,026,796 A * 2/2000 LaPorte ..... F41J 9/18 124/7
6,176,229 B1 * 1/2001 Patenaude ..... F41B 3/04 124/8
6,276,350 B1 * 8/2001 Davey ..... F41J 9/18 124/8
7,263,986 B2 * 9/2007 Lovell ..... F41J 9/24 124/9
7,637,255 B1 * 12/2009 Freeland ..... F41J 9/22 124/7
8,899,216 B2 * 12/2014 Laporte ..... F41J 9/18 124/26

(Continued)

*Primary Examiner* — Alexander R Niconovich
(74) *Attorney, Agent, or Firm* — Fox Rothschild LLP

(57) ABSTRACT

A system for launching a target disk above a terrestrial surface, including a first support, a first bracket attached to the first support, a second support connected to the first bracket and configured to pivot with respect to the first bracket in a first plane, and a second bracket attached to the second support and configured to pivot with respect to the second bracket in a second plane, the second plane being generally perpendicular to the first plane. A launching structure is attached to the second bracket, and the second support is configured to pivot with the second bracket. A track is configured to hold and direct the target upon launching, the track being configurable to present the target to be launched in a first presentation generally parallel to the terrestrial surface and a second presentation generally perpendicular to the terrestrial surface.

19 Claims, 17 Drawing Sheets

(56) References Cited

U.S. PATENT DOCUMENTS

| | | | | |
|---|---|---|---|---|
| 8,919,331 | B2 * | 12/2014 | Rennert | F41J 9/18 124/1 |
| 8,943,945 | B1 * | 2/2015 | Collins | F41J 9/20 124/16 |
| 9,052,169 | B2 * | 6/2015 | Laporte | F41J 9/24 |
| 9,057,589 | B2 * | 6/2015 | Laporte | F41J 9/18 |
| 9,086,257 | B2 * | 7/2015 | Laporte | F41J 9/16 |
| 9,163,913 | B2 * | 10/2015 | Laporte | F41J 9/30 |
| 2013/0104867 | A1 * | 5/2013 | Laporte | F41J 9/18 124/41.1 |
| 2016/0327379 | A1 * | 11/2016 | Laporte | F41J 9/24 |
| 2017/0052003 | A1 * | 2/2017 | Liu | F41J 9/18 |
| 2018/0372459 | A1 * | 12/2018 | Laporte | F41J 9/18 |

* cited by examiner

TARGET DISK THROWING SYSTEM

FIELD

The present disclosure relates generally to methods and configurations for throwing a target. More specifically, certain aspects of the disclosure relate to apparatuses, methods and systems for throwing a target such as a clay bird or other item for use as a target for shooting and/or for other purposes.

BACKGROUND

In a trapshooting, a machine or a hand-held device may be used to throw a target disk, such as a clay target, or "pigeon," the target disks being referred to herein individually as a "bird" and collectively as "birds." The throwing machine or device is used to throw a bird downrange from a shooter. The shooter typically tries to shoot the bird as it flies through the air, or, in some instance, as it rolls and/or bounces across the ground, in which case the target may be referred to as a "rabbit."

There are at least five different types of clay target disks, including: (a) the standard target, which is the most common and which is approximately 110 mm in diameter; (b) the midi target, which is approximately 90 mm in diameter; (c) the mini target, which is approximately 60 mm in diameter; (d) the battue target, which is very thin and is approximately 108-110 mm in diameter; and (e) the rabbit target, which is thicker than the battue target and is approximately 108-110 mm in diameter and is designed to be launched from a vertical disposition and to roll along the ground.

While various machines and devices exist for throwing target disks, typically, a throwing device is configured to throw a target from either a horizontal disposition, wherein a target disk is disposed generally parallel to the ground, or a vertical disposition, wherein a disk-shaped clay target is disposed generally perpendicularly with respect to the ground. Such throwing devices are not typically configured allowing a single device to selectively throw a target from either a vertical disposition or a horizontal disposition.

Further limitations and disadvantages of conventional and traditional approaches may become apparent to one of skill in the art, through comparison of such systems with teachings and example implementations set forth in the present disclosure.

Accordingly, it would be desirable to provide a target disk throwing system wherein a single device is capable of selectively throwing a target disk from either a vertical disposition or a horizontal disposition.

SUMMARY

It would be desirable to provide an apparatus and method that address at least some of the issues discussed above, as well as other potential issues. Moreover, it would be beneficial to furnish system for selectively throwing a target from either a vertical or horizontal disposition.

Accordingly, apparatuses and methods are disclosed for throwing a target disk substantially as shown in and/or described in connection with at least one of the figures, and as set forth more completely in the claims.

More specifically, examples of the present disclosure are generally directed to apparatuses, systems, and methods for throwing an article for use as a target for shooting, articles used in training of animals (such as hunting dogs), and/or articles used in recreational endeavors, games, sports, etc., and/or articles used in agricultural, industrial, commercial, construction, or military sectors, etc.

In one example implementation, an apparatus is disclosed for launching a target, with the apparatus including a support structure and a launching structure pivotally connected to the support structure and movable between an armed position and a disarmed, or stop, position. One or more mechanisms deliver an impulse force that impels the launching structure from the armed position to the disarmed position.

The throwing system disclosed herein is configured to launch, generally without structural modification, four different styles of clay shooting targets presently manufactured, namely, standard target disks, midi target disks, mini target disks, battue target disks, and with the inclusion of a retainer, a fifth style of target disks, namely, rabbit target disks. These targets may be launched in horizontal and vertical positions, with the ability to adjust variations in angle and attitudes as well as altitude. The throwing system disclosed herein further allows the desired horizontal and vertical presentations from a single secured base launching platform, which may also be rotated 360 degrees.

An exemplary implementation includes a system for launching a target disk above a terrestrial surface, having a first support, a first bracket attached to the first support, a second support connected to the first bracket and configured to pivot with respect to the first bracket in a first plane, and a second bracket attached to the second support and configured to pivot with respect to the second bracket in a second plane, the second plane being generally perpendicular to the first plane. A launching structure is attached to the second bracket and the second support is configured to pivot with the second bracket. An elongated track is provided on the launching structure and is configured to hold the target disk and to direct the target disk upon launching of the target disk, the track being configurable to present the target disk to be launched in a first presentation generally parallel to the terrestrial surface and a second presentation generally perpendicular to the terrestrial surface. A launching member is connected to the launching structure that selectively contacts the target disk to launch the target disk from the track, and an impulse force device is connected to the launching structure that selectively impels the launching member to contact and launch the target disk from the track.

In other or the same implementation, the system includes the first bracket being configured rotate substantially 360 degrees with respect to the first support and/or the first bracket defining one or more arcuately-arranged holes, the second support having at least one retainer hole, and a retainer selectively engaging at least one of the arcuately-arranged holes and the retainer hole selectively fixing the second support to the first bracket. In the same or another implementation, the second bracket defines one or more arcuately-arranged holes, and the second support has at least one retainer hole. A retainer selectively engages at least one of the arcuately-arranged holes and the retainer hole to selectively fix the second support to the second bracket.

In the same or another implementation, the track is configurable to be angled between substantially any angular orientation between the first and second orientations of the target disk and/or the first support including a shaft having a generally cylindrical exterior portion and a sleeve configured to receive the shaft and for allowing the shaft to be rotated with respect to the sleeve and to be moved upwardly and downwardly with respect to the sleeve. An adjustable retainer is configured to allow selective releasably fixation of the shaft with respect to the sleeve. In yet another implementation, a resilient material is positioned on the track and is configured to introduce resistance to the target disk induce rotation of the disk upon the launching of the disk from the track.

In further implementations, or in one or more of the above implementations, the system includes a retainer selectively releasably attachable to the launching member, wherein upon the retainer being attached to the launching member, the retainer retains the target disk on the track prior to launching of the target disk. This configuration can be used in particular when the target disk launching device presents rabbit target disks in a generally vertical presentation, with respect to the ground, i.e., a terrestrial surface, it being understood that as used herein, a terrestrial surface could also include a body of water, marsh, swamp, etc.

Implementations could also include the impulse force device having at least one electromagnetic driver connected to the launching structure, and, implementations can include the impulse force device including a tensioning spring and a threaded anchor connected to the tensioning spring and the launching structure, wherein rotation of the threading anchor adjusts the tension in the tensioning spring and the force by which the impulse force device impels the launching member to contact and launch the target disk.

Implementations of the present disclosure could the impulse force device including a motor and a shaft connected to the motor for rotation by the motor, and the launching member is connected to the shaft for rotation with the shaft, the launching member being movable between a disarmed position and an armed position. A one-way bearing is adapted to receive the shaft and to allow the shaft to rotate in only one direction. A first arm is attached to the shaft, and a second arm attached to the first arm and configured to pivot with respect to the first arm. A spring is connected to the second aim. A limit switch is connected to the motor and is configured to de-energize the motor upon the first arm rotating into proximity with the limit switch, wherein the spring is in tension against the second arm, and the launching member is in the armed position; wherein, upon re-energization of the motor, the launching member is first rotated by the motor and then moves substantially under the force of the spring acting through the second arm, the first arm, and the shaft to impel and launch the target.

Implementations of the present disclosure also include a method for launching a target disk, including providing a first support, a first bracket attached to the first support, and a second support connected to the first bracket, the first support being configured to pivot in a first plane with respect to the first bracket, a second bracket and a launching structure attached to the second bracket attached to the second support, the launching structure being configured to pivot with respect to the second bracket in a second plane, the second plane being generally perpendicular to the first plane, and also providing an elongated track provided on the launching structure. The method further includes manipulating the track to present the target disk to be launched in a first presentation generally parallel to the terrestrial surface and manipulating the track to present the target disk to be launched in a first presentation generally perpendicular to the terrestrial surface, and further, providing a launching member connected to the launching structure configured to selectively contact the target disk to launch the target disk from the track, and an impulse force device connected to the launching structure that, upon activation, selectively impels the launching member to contact and launch the target disk from the track. Additionally, the method includes placing the target disk on the track and activating the impulse force device such that the impulse device impels the launching member to contact and launch the target disk from the track.

The same or other implementations of methods disclosed herein include rotating the first bracket through an arc with respect to the first support and/or rotating the second support through an arc with respect to the first bracket; and selectively fixing the second support to the first bracket. Implementations can also include rotating the launch structure through an arc with respect to the second bracket and selectively fixing the launch structure to the second bracket.

Implementations may include attaching a retainer to the launching member configured to retain retains the target disk on the track prior to launching of the target disk and/or providing a tensioning spring connected to the impulse force device and a threaded anchor connected to the tensioning spring and the launching structure and rotating the threading anchor to adjust the tension in the tensioning spring and the force by which the impulse force device impels the launching member to contact and launch the target disk.

Moreover, implementations disclosed herein include the placing of the target disk on the track and launching the target disk from the track includes placing and launching, one at a time and in no particular order, a standard target disk, a midi target disk, a mini target disk, a battue target disk, and a rabbit target disk.

In other aspects of the disclosure, methods, systems and/or apparatuses are provided for throwing, propelling, impelling, and/or launching an article generally from a resting position.

The features, functions and advantages discussed herein may be achieved independently in various example embodiments or may be combined in yet other example embodiments further details of which may be seen with reference to the following description and drawings.

BRIEF DESCRIPTION OF THE DRAWINGS

Figure 1:
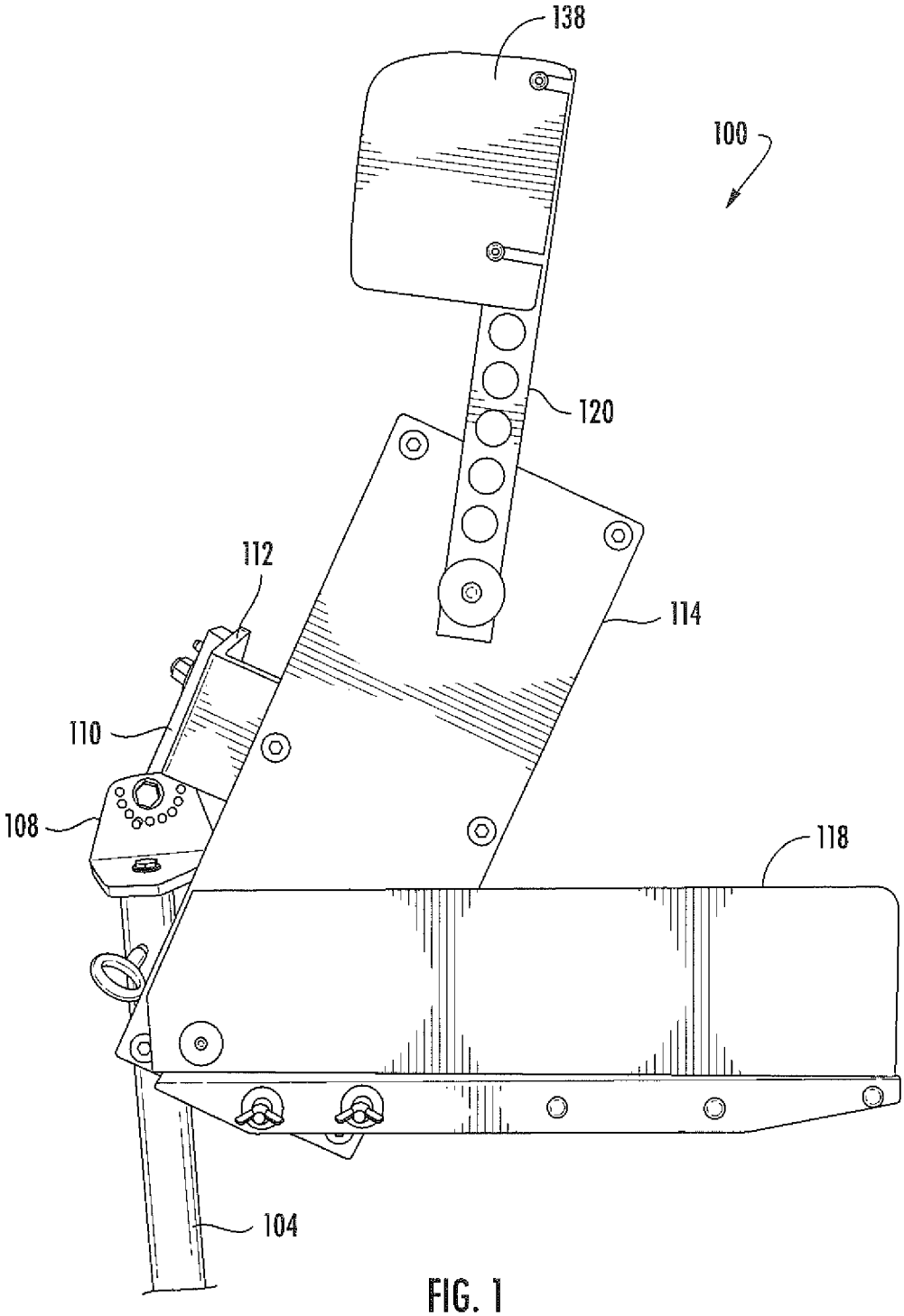
Figure 2:
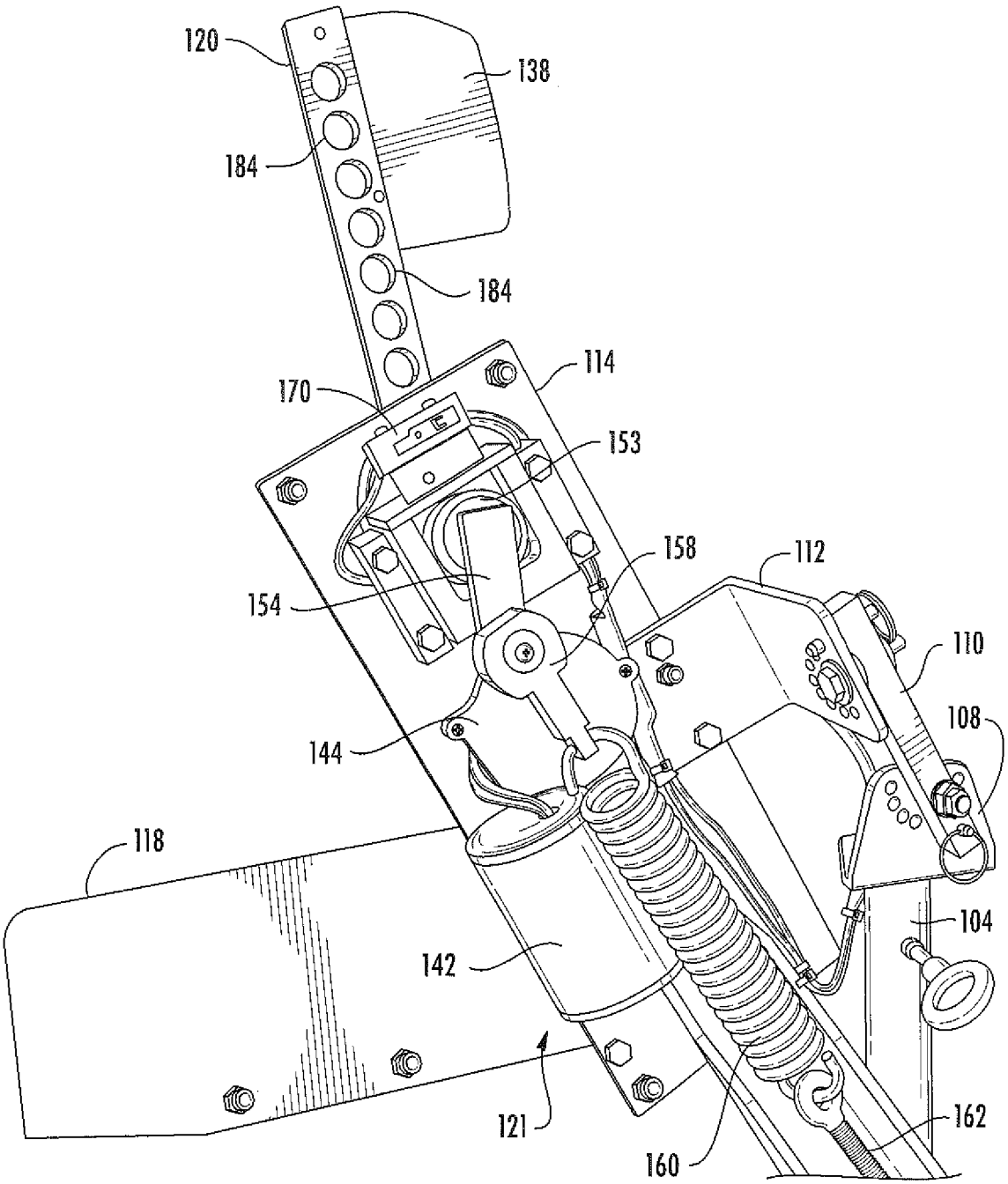
Figure 3:
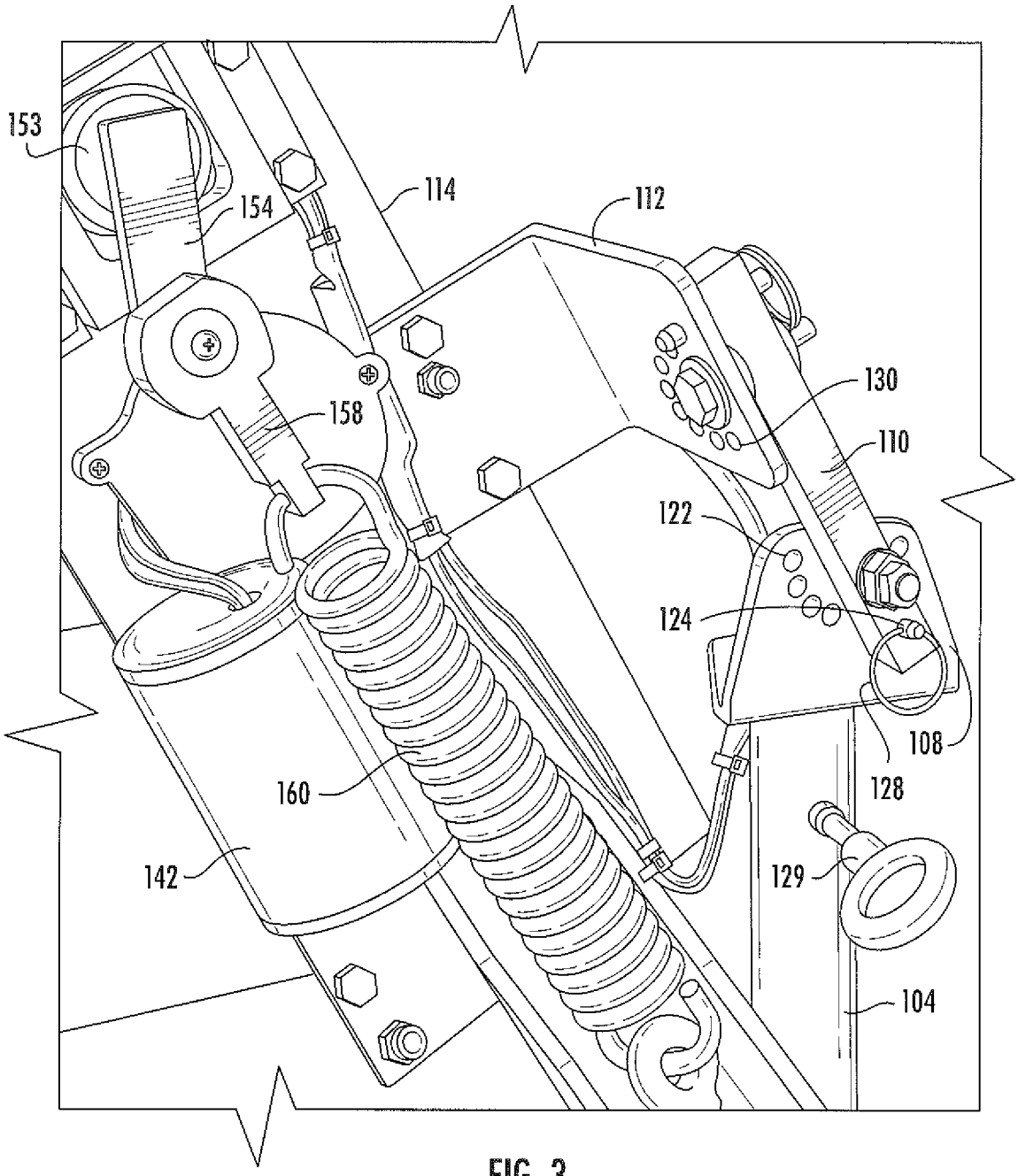
Figure 4:
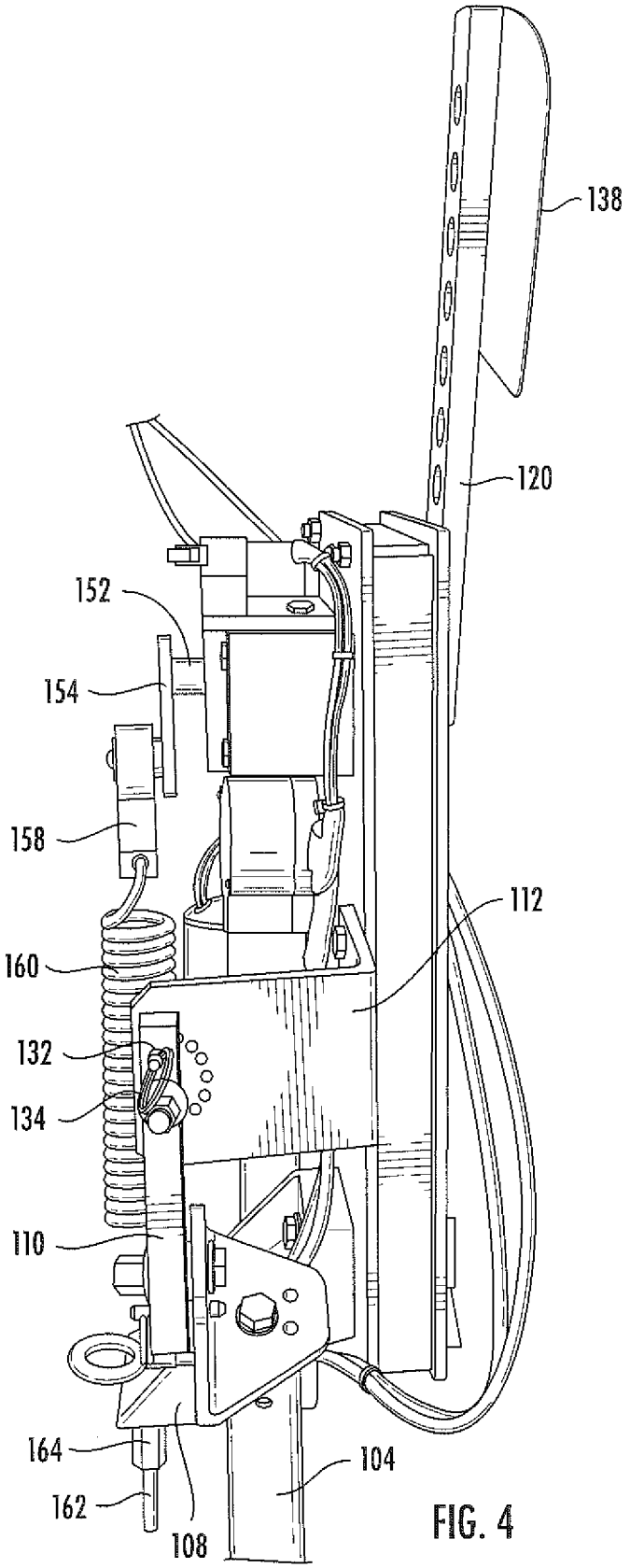
Figure 5:
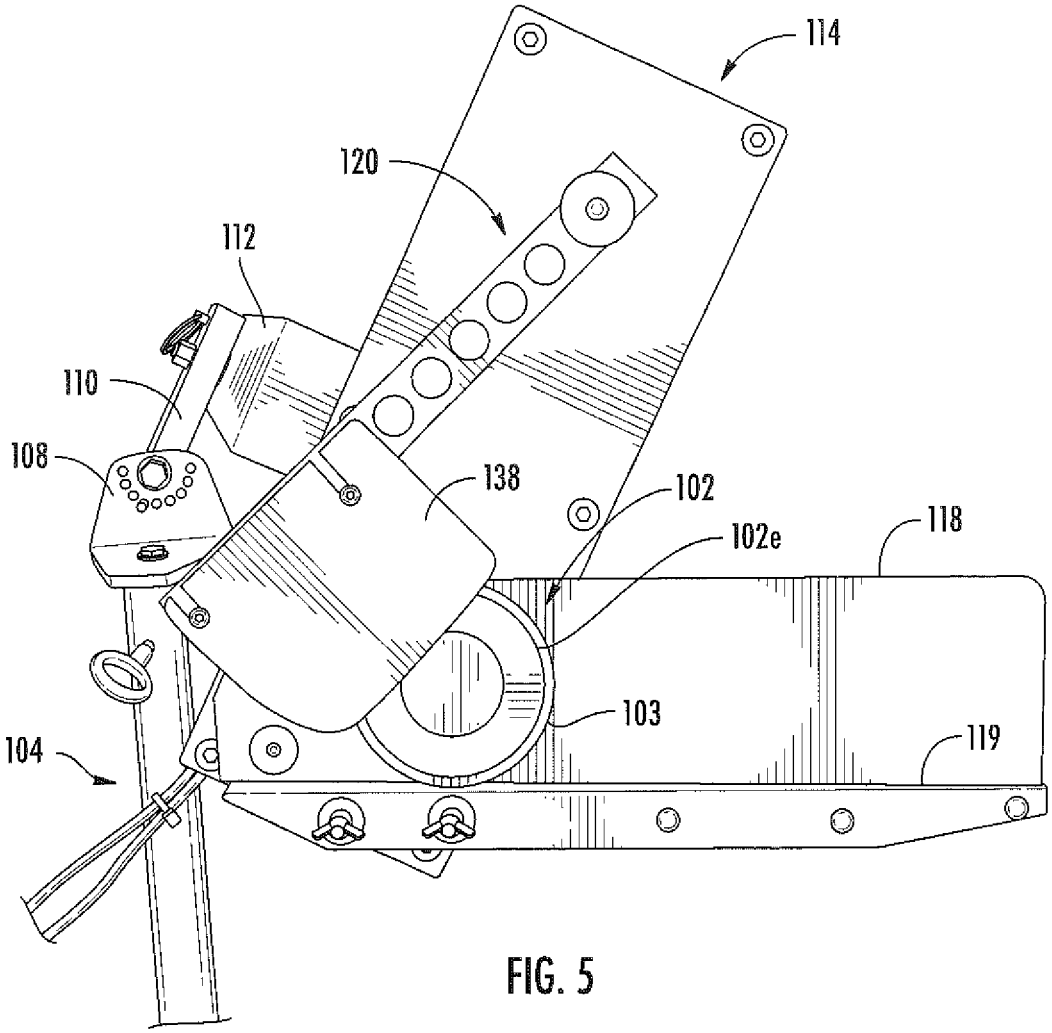
Figure 6:
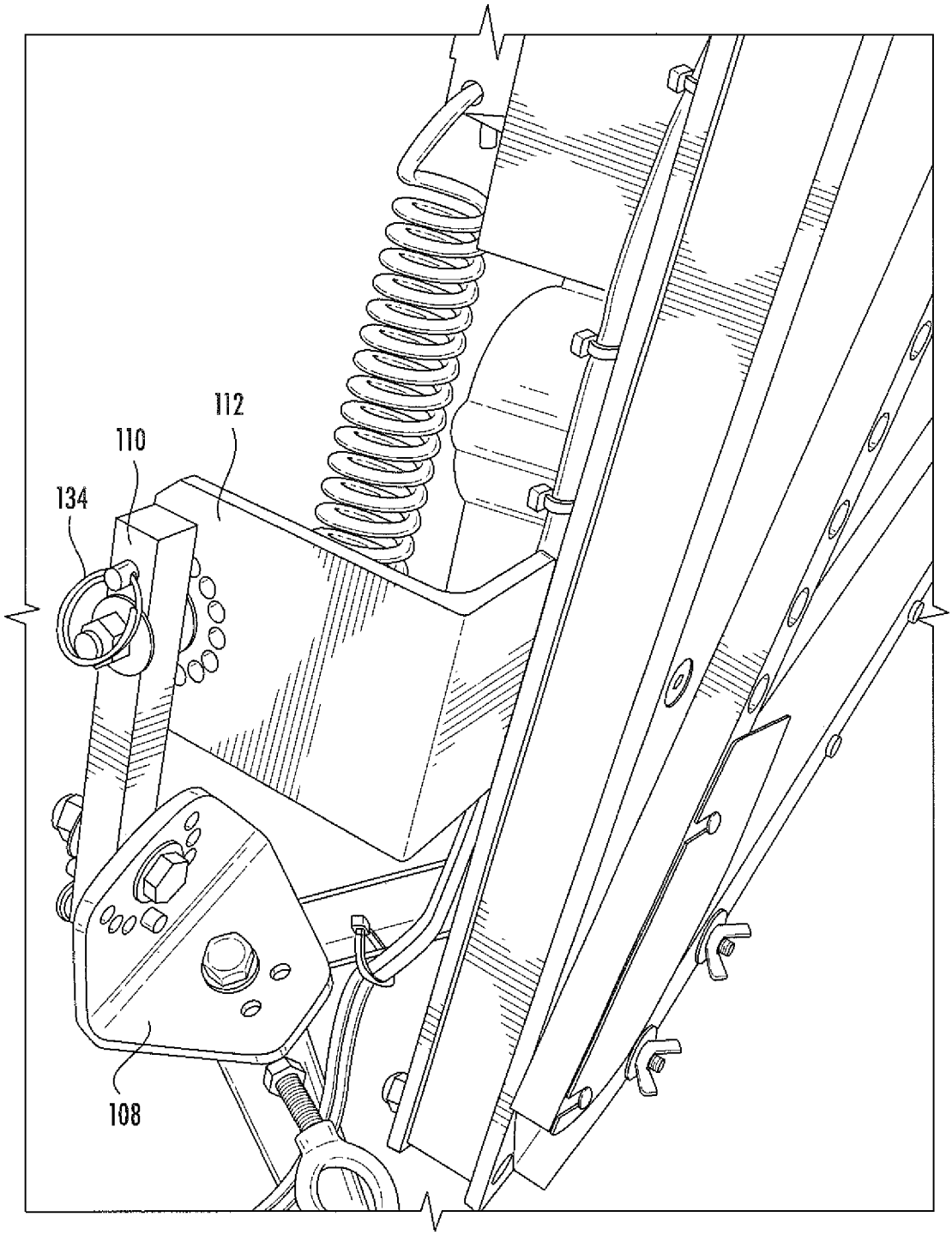
Figure 7:
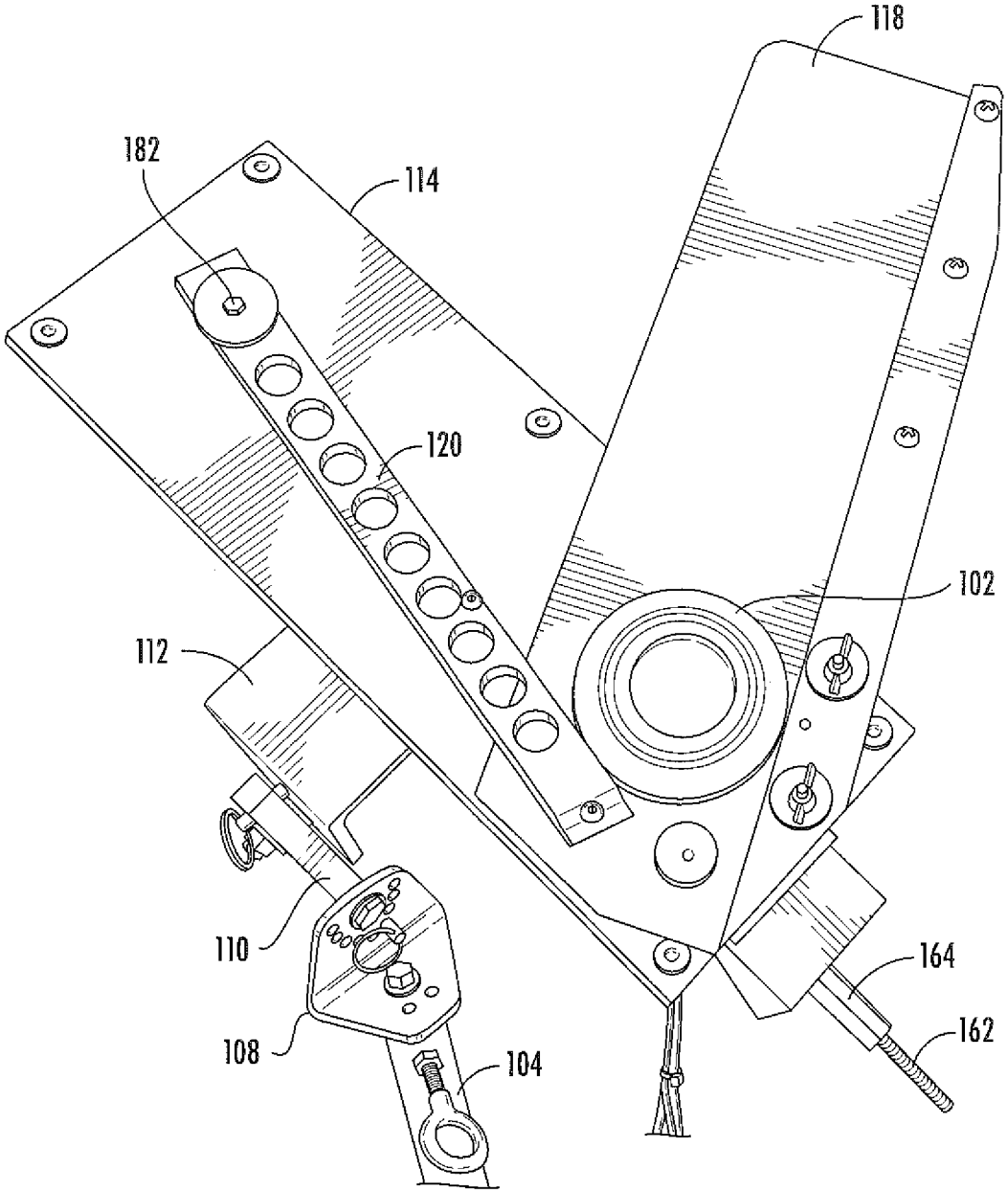
Figure 8:
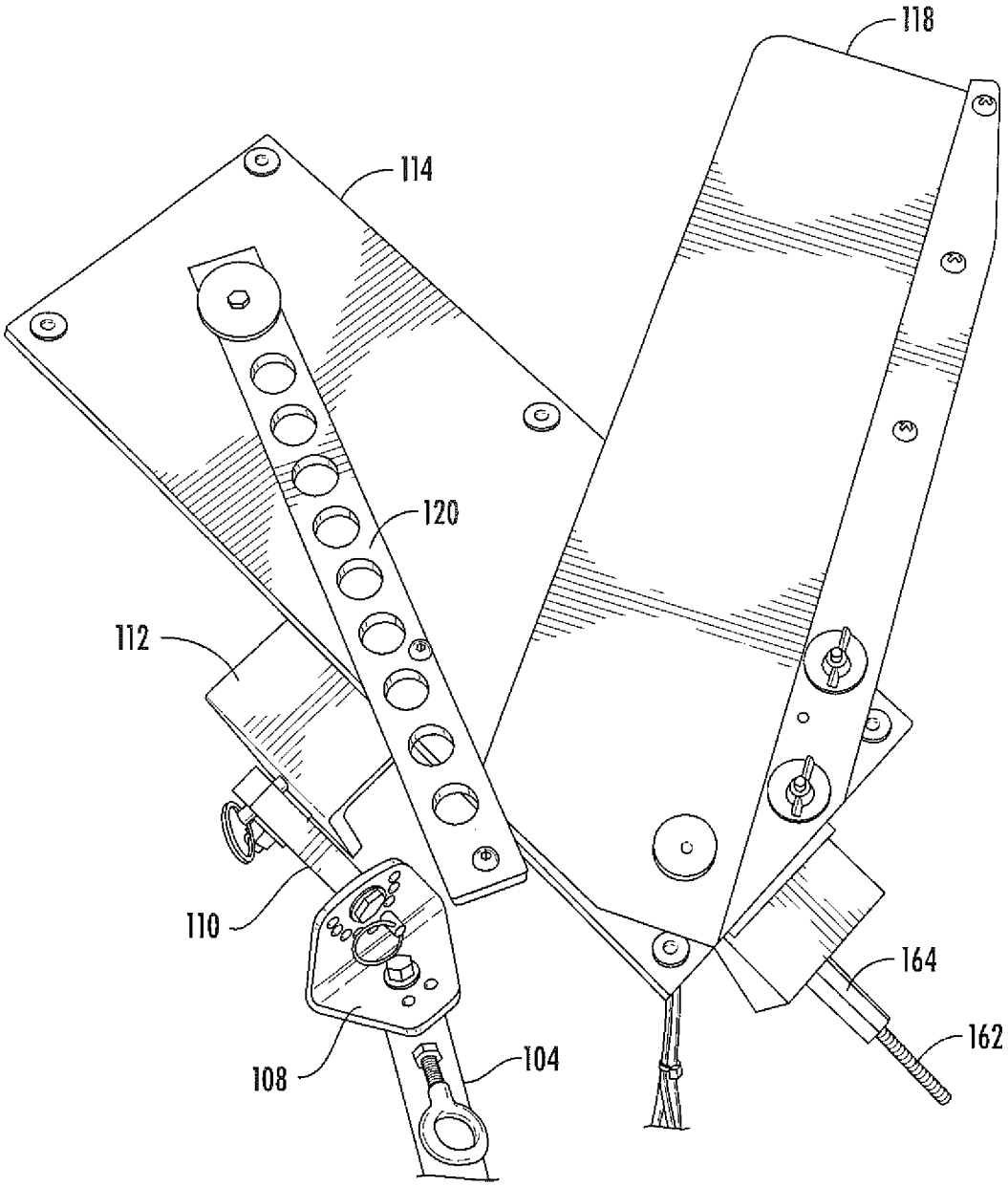
Figure 9:
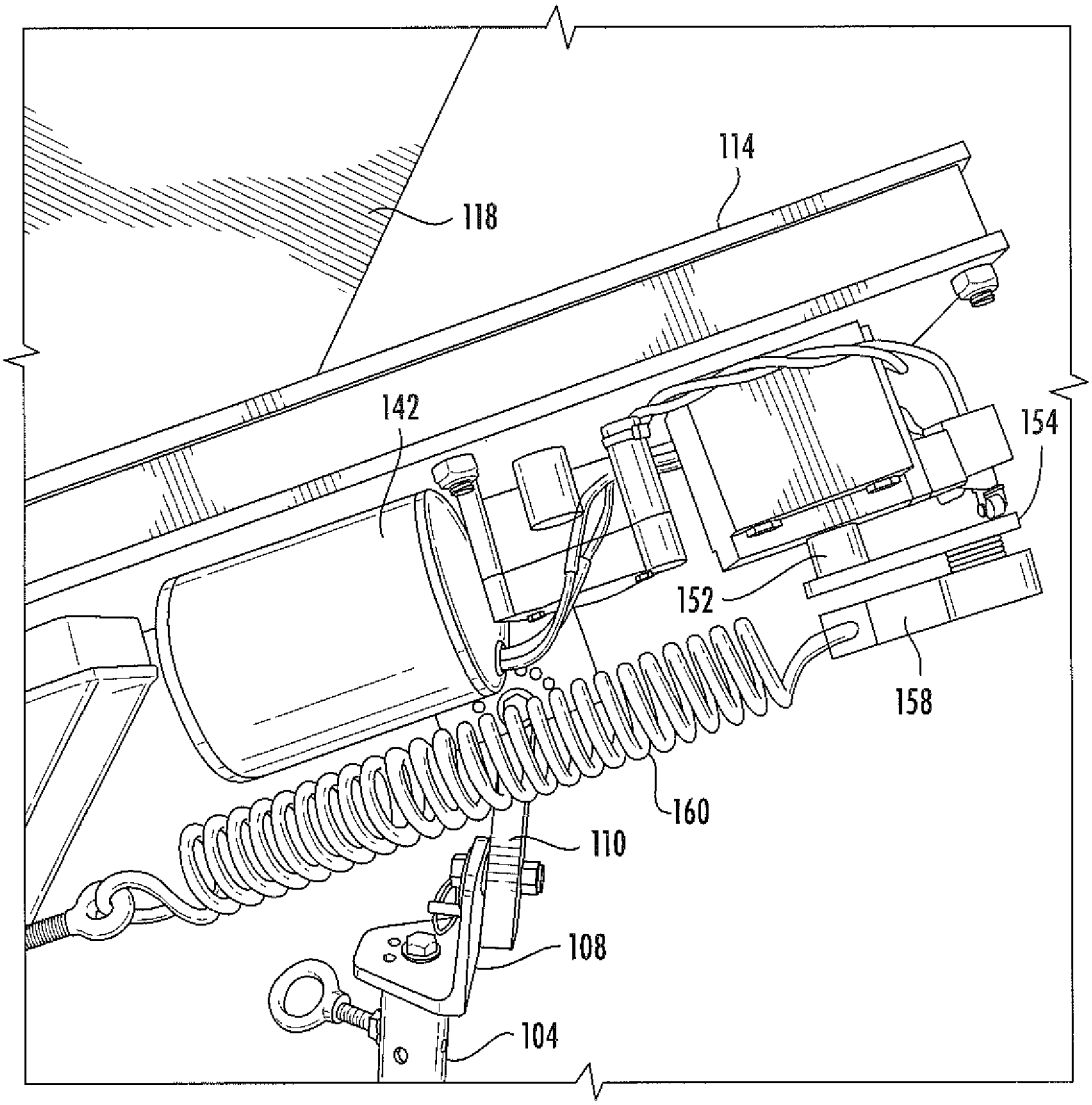
Figure 10:
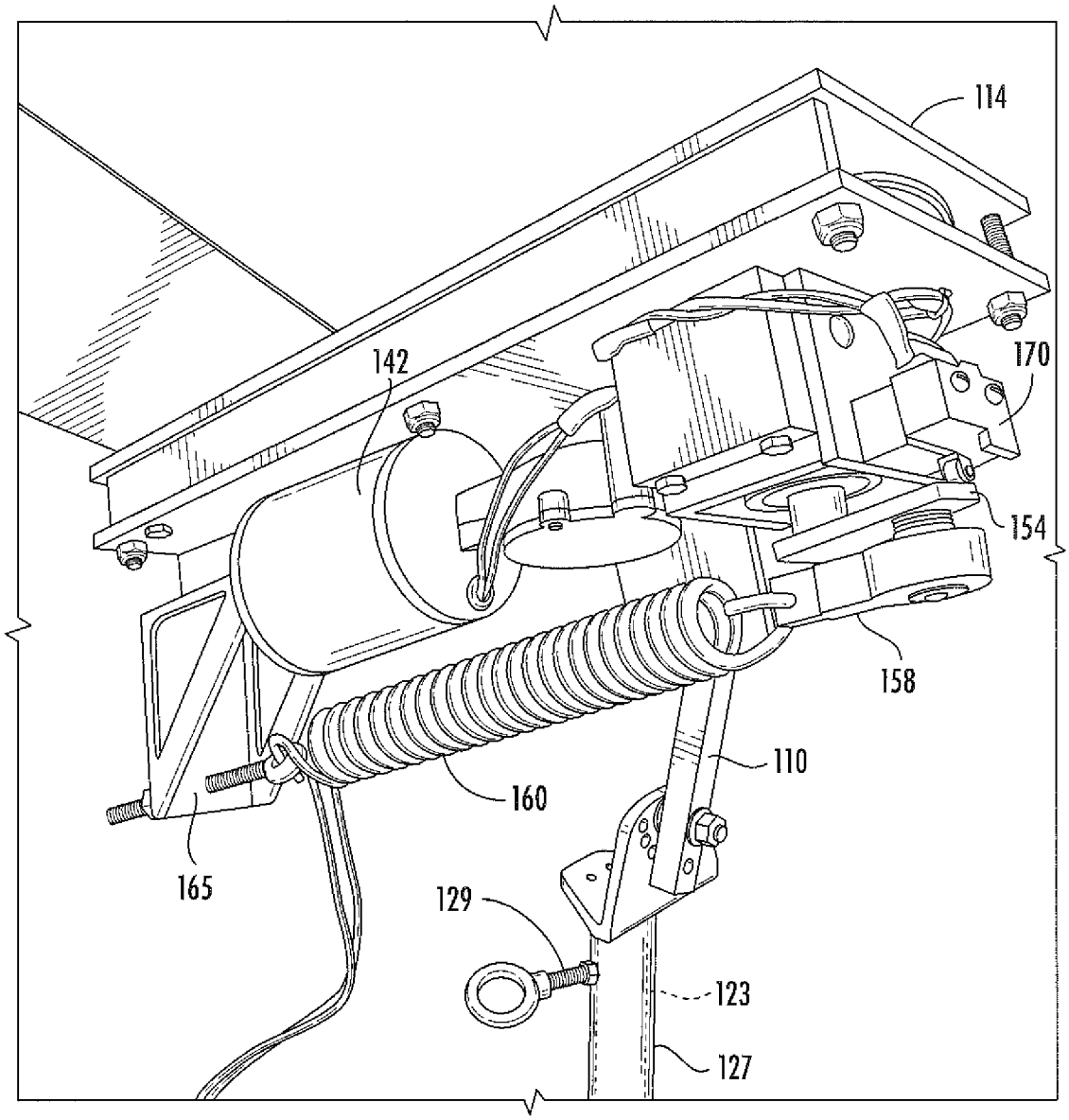
Figure 11:
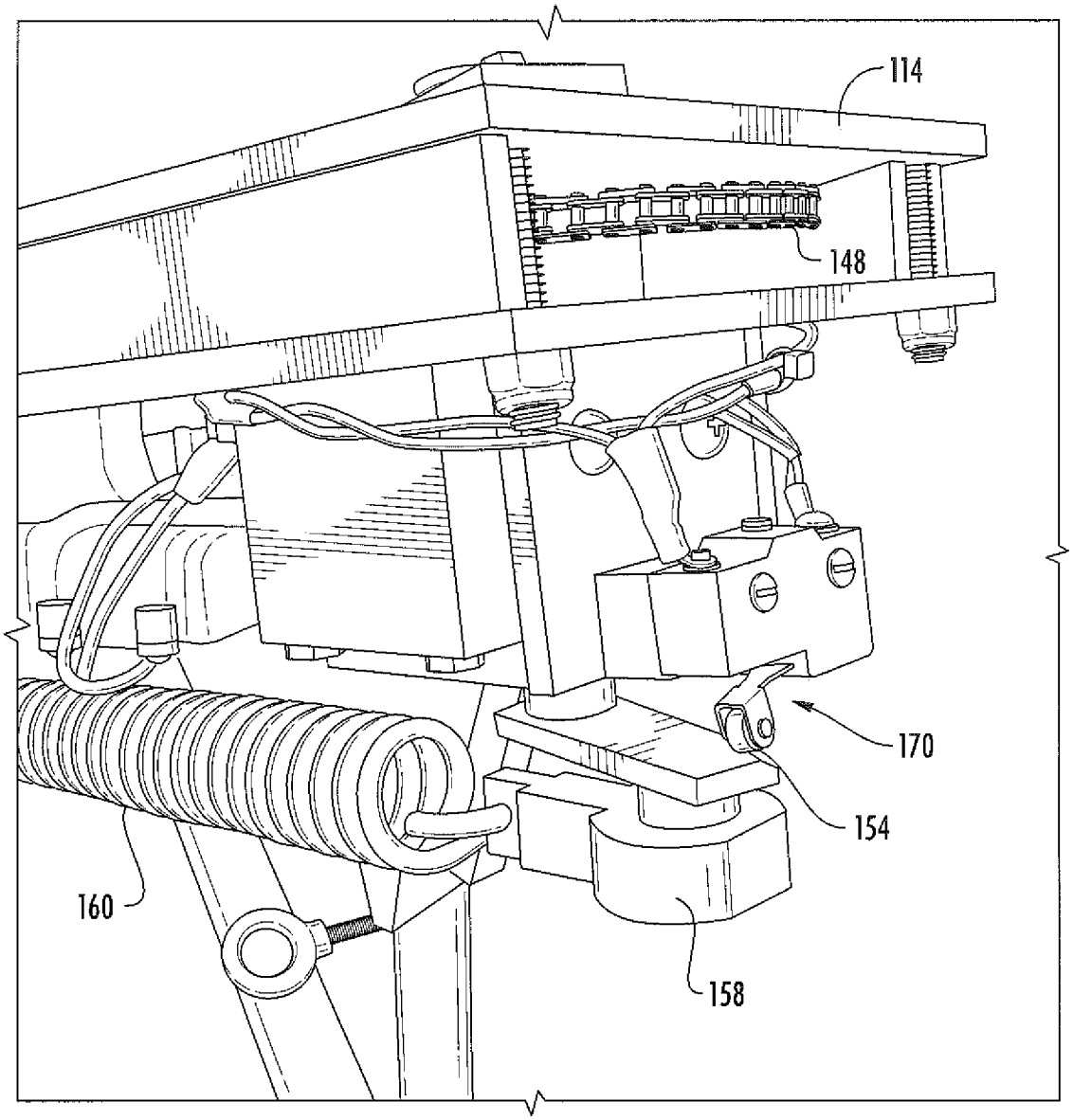
Figure 12:
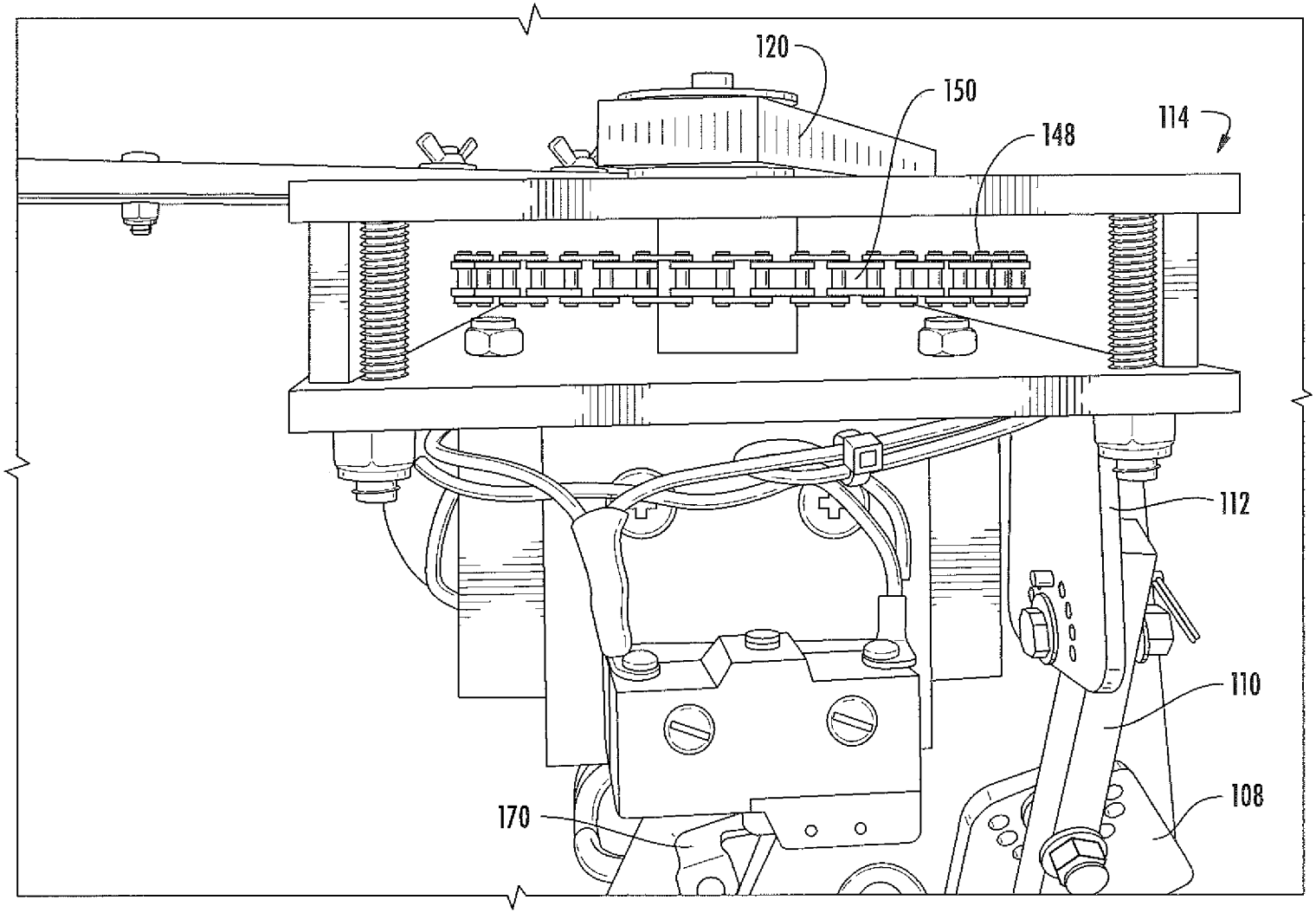
Figure 13:
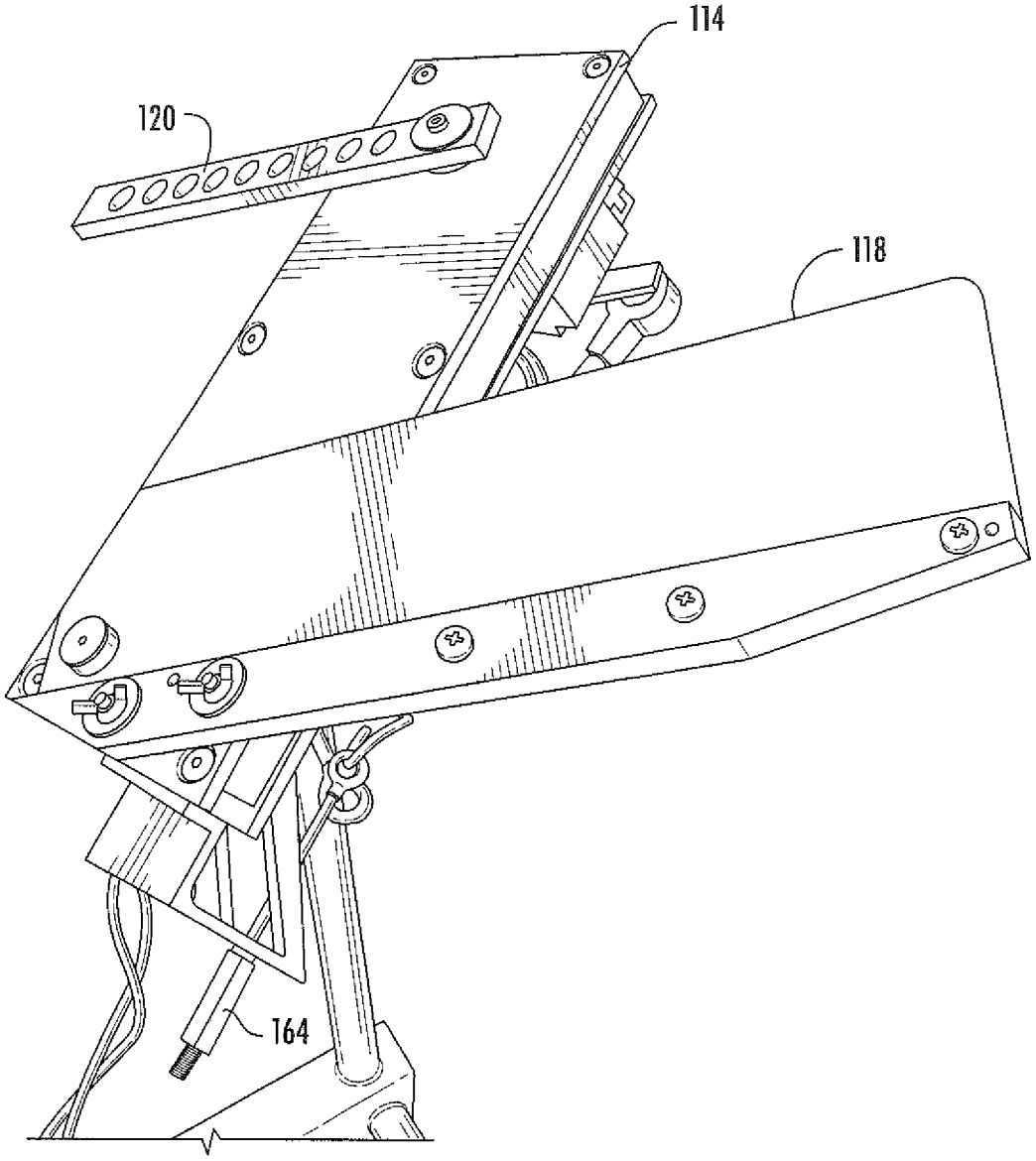
Figure 14:
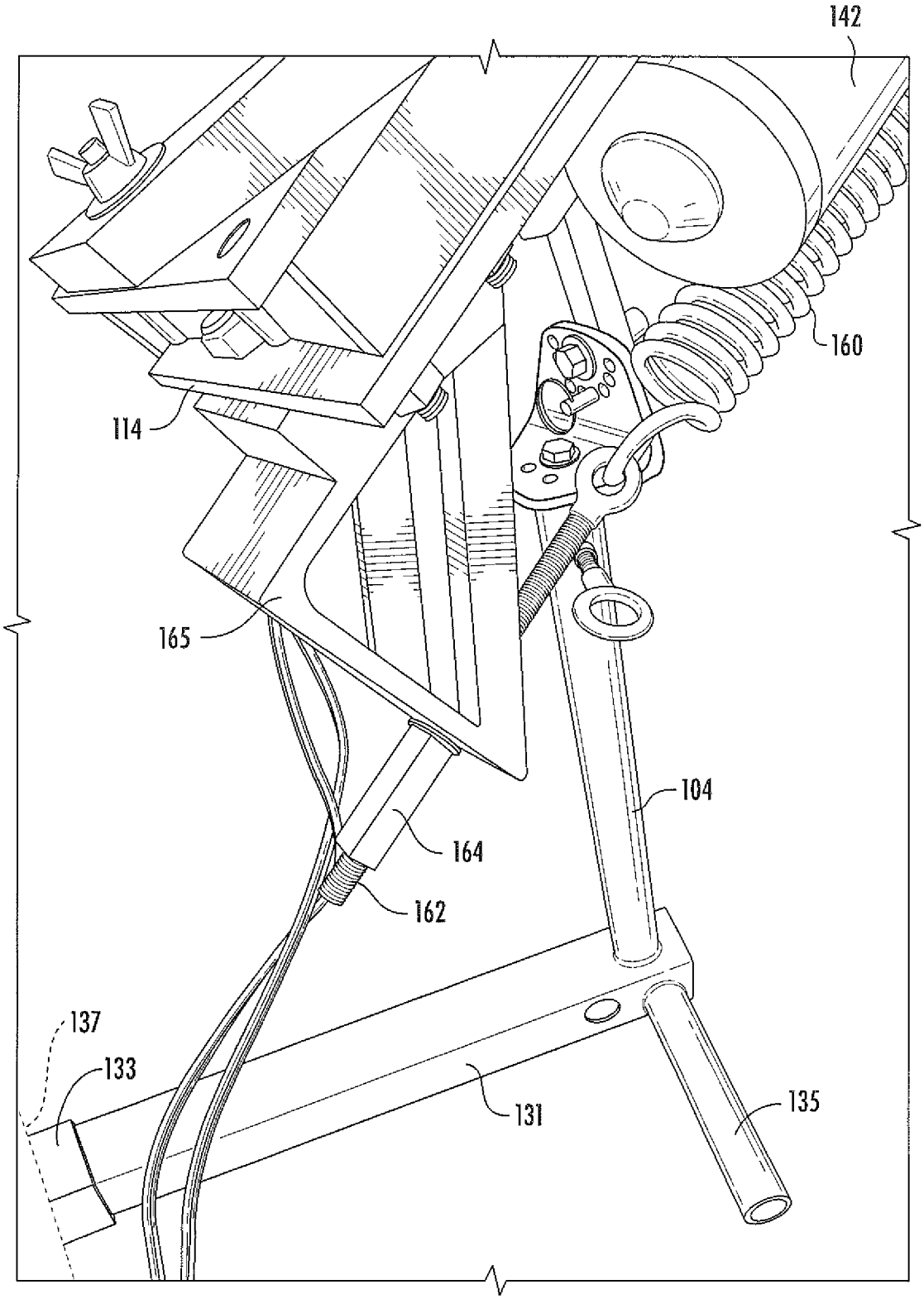
Figure 15:
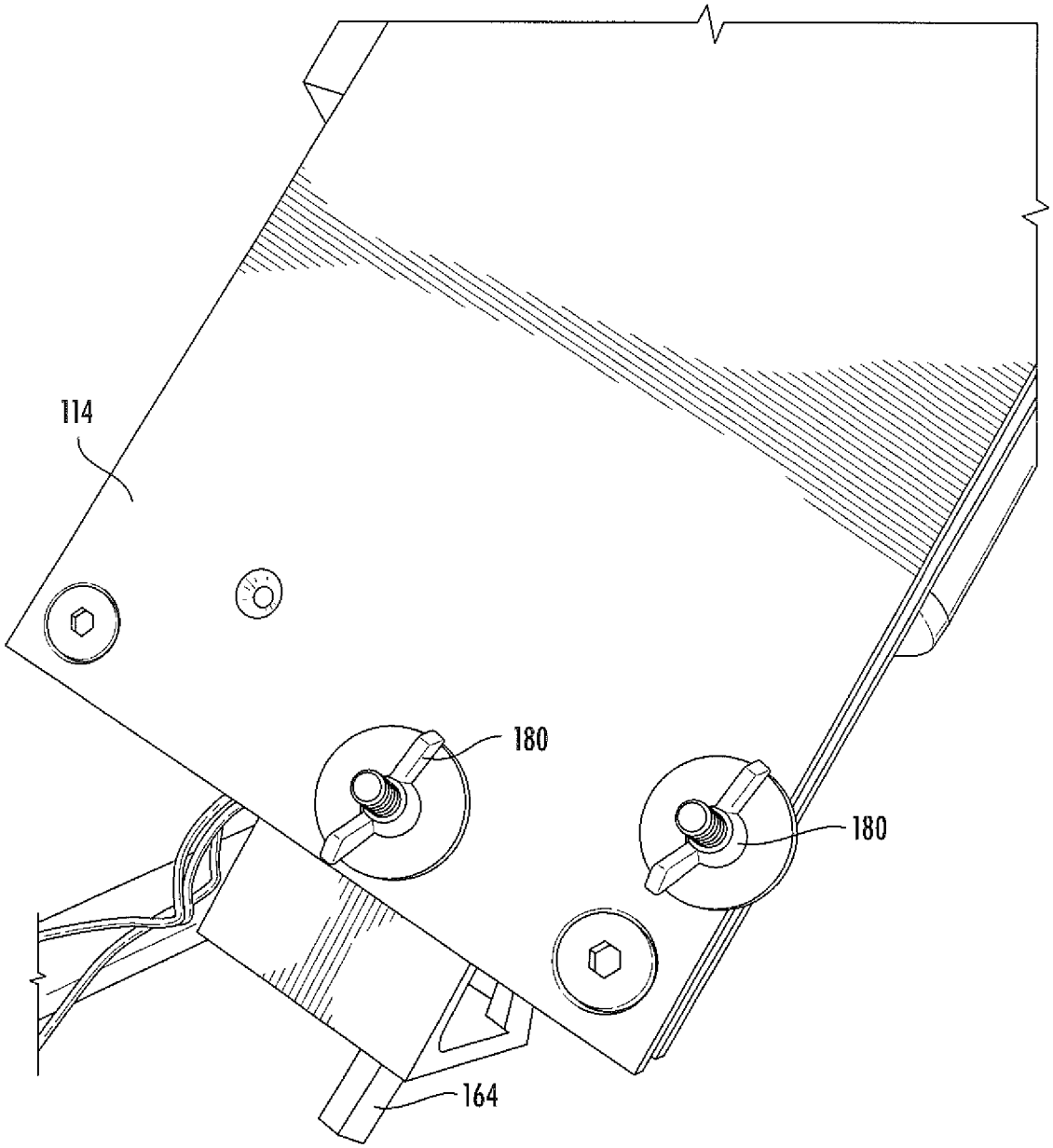
Figure 16:
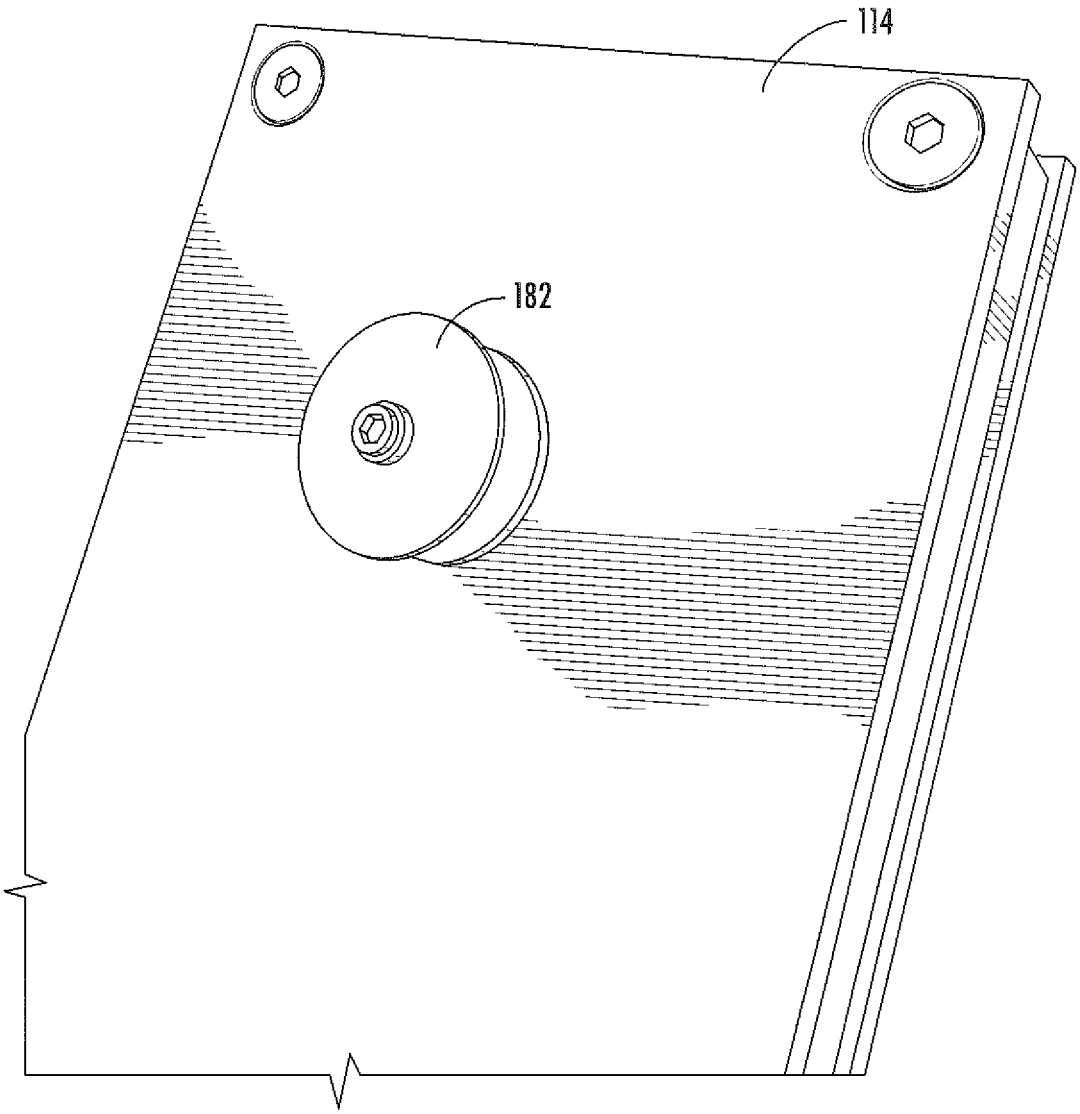
Figure 17A:
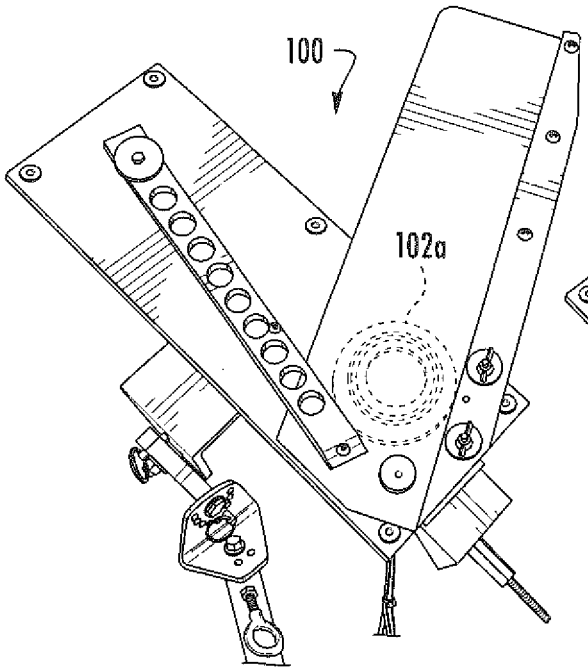
Figure 17B:
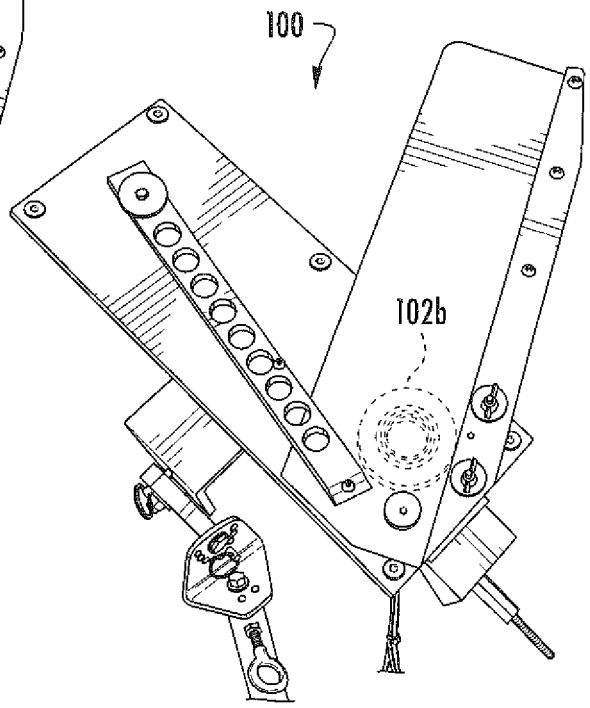
Figure 17C:
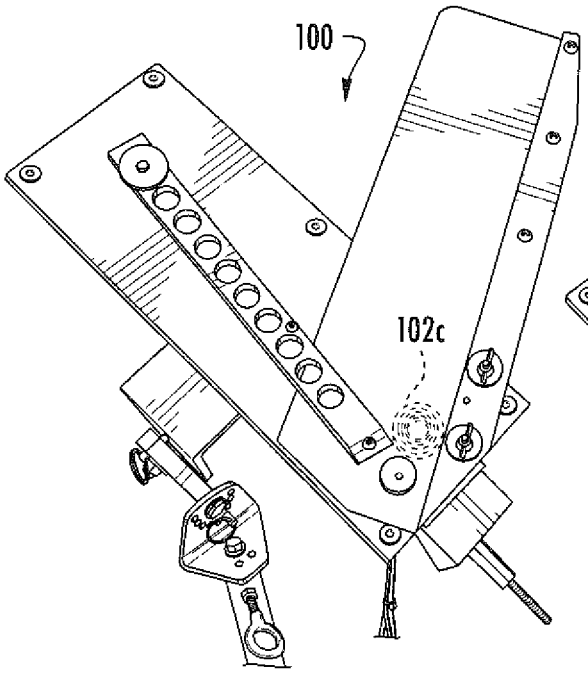
Figure 17D:
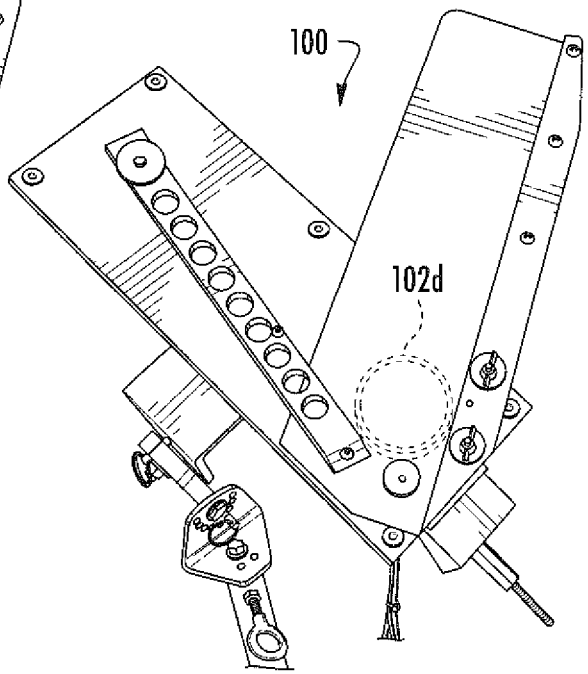

Having thus described exemplary aspects of the disclosure in general terms, reference will now be made to the accompanying drawings, which are not necessarily drawn to scale, and wherein:

FIG. 1 illustrates an elevational view of an example target disk throwing system as disclosed herein configured in accordance with the present disclosure for presentation of a target disk generally perpendicular to the ground or other terrestrial surface, and includes a launching member in a disarmed state;

FIG. 2 illustrates a perspective view of a portion of an example target disk throwing system as discussed herein, and an impulse force device thereof;

FIG. 3 illustrates a perspective view of a tensioning spring of an example target disk throwing system as discussed herein;

FIG. 4 illustrates a perspective view of an example target disk throwing system as discussed herein, in a disarmed configuration;

FIG. 5 is an elevational view of an example target disk throwing system as discussed herein configured for presentation of a target disk generally perpendicular to the ground or other terrestrial surface;

FIG. 6 is a partial perspective view of an example target disk throwing system as discussed herein illustrating a first bracket, the second support, and the second bracket;

FIG. 7 is a perspective view of an example target disk throwing system as disclosed herein, wherein a target disk is in a presentation generally parallel to the ground or other terrestrial surface;

FIG. 8 is a partial perspective view of an example target disk throwing system as discussed herein illustrating the launching member having multiple holes along its length, thereby allowing adjustment as to the radius of the launching member with respect to a drive shaft;

FIG. 9 is a partial perspective view of an example target disk throwing system as discussed herein illustrating a portion of an impulse force device and a tensioning spring;

FIG. 10 is a partial perspective view of an example target disk throwing system as discussed herein illustrating an impulse force device, tensioning spring, and threaded anchor connected to the tensioning spring;

FIG. 11 is a partial perspective view of an example target disk throwing system as disclosed herein, illustrating an impulse force device in an armed position;

FIG. 12 is a partial perspective view of an example target disk throwing system as discussed herein illustrating a portion of the impulse force device;

FIG. 13 is a partial perspective view of an example target disk throwing system as disclosed herein;

FIG. 14 is a partial perspective view of an example target disk throwing system as disclosed herein, illustrating a first support includes a member receivable in a hitch of a vehicle or other structure;

FIG. 15 is a partial perspective view of an example target disk throwing system constructed in accordance with the present d;

FIG. 16 is a partial perspective view of an example target disk throwing system constructed in accordance with the present invention; and FIGS. 17A through 17D are partial perspective views of an example target disk throwing system in accordance with the present disclosure, illustrating the throwing system being used to throw four different types of clay targets.

DETAILED DESCRIPTION

Some examples of the present disclosure will now be described more fully hereinafter with reference to the accompanying drawings, in which some, but not all examples of the disclosure are shown. Indeed, various aspects of the disclosure may be embodied in many different foul's and should not be construed as limited to the examples set forth herein. Rather, these examples are provided so that this disclosure will be thorough and complete and will fully convey the scope of the disclosure to those skilled in the art. Like reference numerals refer to like elements throughout.

As used herein, "and/or" means any one or more of the items in the list joined by "and/or". As an example, "x and/or y" means any element of the three-element set, e.g., {(x), (y), (x, y)}. Additionally, as used herein, the terms "example" and "exemplary" means serving as a non-limiting example, instance, or illustration. Moreover, as used herein, the term, for example, or "e.g.," introduces a list of one or more non-limiting examples, instances, or illustrations.

Referring more particularly to the drawings, examples of the present disclosure include apparatus, methods and systems for throwing an article, or target disk, which may be described in the context of throwing a target in a shooting activity. This target, or target disk, could be an article, such as a "pigeon," "clay pigeon," "bird," or any other suitable article.

Turning to FIG. 1 of the drawings, an exemplary implementation of a target disk throwing system, generally 100, in accordance with the present disclosure is illustrated for launching a target, generally 102, above a terrestrial surface. The system 100 a first support, generally 104, a first bracket 108 attached to the first support 104, a second support 110 connected to the first bracket 108 and configured to pivot with respect to the first bracket 108 in a first plane, and a second bracket 112 attached to the second support 110 and configured to pivot with respect to the second bracket 112 in a second plane, the second plane being generally perpendicular to the first plane.

A launching structure, generally 114, is attached to the second bracket 112, and the second support 110 is configured to pivot with the second bracket 112. An elongated track 118 is provided on the launching structure 114 and is configured to hold the target disk 102 and to direct the target disk upon launching of the target disk, the track 118 being configurable to present the target disk 102 to be launched in a first presentation generally parallel to the terrestrial surface, i.e., a generally horizontal position (as shown in FIGS. 7, 8, 13, and 14) and a second presentation generally perpendicular to the terrestrial surface, i.e., a generally vertical position, as shown in FIGS. 4, 5, and 6. Track 118 may include a friction-inducing and/or resilient surface applied to the floor of track 118, and may include a material 119 in the form of a coating, pad, or mat, (such as a rubber, vinyl, composite, foam, cushion, and/or other resilient member) positioned in the floor of track 118 that engages and provides some resistance to the circumferential edge 103 of a target 102 as target 102 is launched from the track 118 (upon the launching member 120 moving from the armed to the disarmed position). This engagement of the edge of target 102 with the resilient surface or mat tends to induce a spin in target 102 such that target 102 spins in flight, thereby facilitating stabilization of target 102 once in flight. It is noted here that Applicant's U.S. Pat. No. 8,943,945, issued Feb. 3, 2015, entitled, Article Throwing System, is hereby incorporated herein in its entirety by reference.

A launching member 120 is connected to the launching structure 114 that selectively contacts the target disk to launch the target disk 102 from the track, and an impulse force device, generally 121, is connected to the launching structure that selectively impels the launching member to contact and launch the target disk 102 from the track.

In another or the same implementation, the system 100 includes the first bracket 108 being configured rotate substantially 360 degrees with respect to the first support 104, the first support 104 including a shaft 123 having a generally cylindrical exterior portion and a sleeve 127 configured to receive the shaft 123 and for allowing the shaft 123 to be rotated with respect to the sleeve 127 and to be moved upwardly and downwardly with respect to the sleeve 127. In one implementation, first support 104 includes a member 131 receivable in a hitch 133 of a vehicle 137 or other structure. If mounted in such a manner, the operator could potentially sit on a portion of the vehicle and use member 141 as a footrest and/or for other purposes. It is to be understood that which not shown in the drawings, first support 104 can also be mounted on a tripod, inserted into the ground, mounted in concrete, etc. An adjustable retainer 129, such as a bolt, is configured to allow selective releasably fixation of the shaft with respect to the sleeve.

In yet another implementation, the first bracket 108 defines one or more arcuately-arranged holes, generally 122, the second support having at least one retainer hole 124, and a retainer 128, such as a detent pin, selectively engaging at least one of the arcuately-arranged holes 122 and the retainer hole 124, thereby selectively fixing the second support 110 to the first bracket 108. In the same or another implementation, the second bracket 112 defines one or more arcuately-arranged holes, generally 130, and the second support 110 has at least one retainer hole 132 (FIG. 4). A retainer 134 such as a detent pin, selectively engages at least one of the arcuately-arranged holes 130 and the retainer hole 132 to selectively fix the second support 110 to the second bracket 112. In the same or another implementation, the track 118 is configurable to be angled between substantially any angular orientation between the first and second orientations of the target disk 102.

In further implementations, or in one or more of the above implementations, the system 100 includes a target disk retainer 138 selectively releasably attachable to the launching member 120, wherein upon the target disk retainer 138 being attached to the launching member 120, the target disk retainer 138 retains the target disk 102 on the track 118 prior to launching of the target disk 102. This configuration can be used in particular when the target disk 102 launching device presents a rabbit target disk 102 in a generally vertical presentation (FIG. 5), with respect to the ground, i.e., a terrestrial surface or other applicable surface, it being understood that as used herein, a terrestrial surface could also include a body of water, marsh, swamp, ice, etc.

Implementations consistent with the teachings of the present disclosure could also include an impulse force device, generally 121 (FIG. 2), having at least one electromagnetic driver, such as a motor 142 connected to the launching structure 114, which, acting through a gear reduction unit 144 connected to a sprocket (not shown) driving a chain 148 (FIG. 12) (which, in turn drives a larger sprocket 150) rotates and cocks, or arms, launching member 120. Motor 142 can be AC and/or DC powered as desired. More specifically, motor 142 rotates sprocket 150, which is connected to a shaft 152 (FIG. 4) carried an a one-way bearing 153 (which only allows shaft 152 to rotate in one direction, namely, the clockwise direction in the implementation of the system 100 shown in FIGS. 2 and 3) An arm 154 is attached to shaft 152 for rotation therewith. Pivotally attached to the arm 154 is an attachment arm 158, which in turn is attached to a tensioning spring 160, such as a coil spring. A threaded anchor 162 threadingly received in bracket 165 (FIG. 10) having an adjustment nut 164 is connected to the tensioning spring 160 and the launching structure 114, wherein rotation of the threading anchor 162 and/or adjustment nut 164 (FIGS. 4 and 14) adjusts the tension in the tensioning spring 160 and the force by which the impulse force device 121 impels the launching member 120 to contact and launch the target disk 102.

In operation, a target disk 102 is inserted on track 118 of launching structure 114 of system 100. The impulse force device 121 is energized such that motor 142 rotates a sprocket (not shown) which drives chain 148, which in turn drives sprocket 150 (FIG. 12), which in turn drives shaft 152. Shaft 152 drives arm 154 attached thereto, and pivoting arm 154 connected to arm 158, pulls on spring 160 and applies tension to spring 160 as shaft 152 and arm 154 rotate. Once arm 154 reaches a limit switch 170, the limit switch 170 is tripped (FIGS. 9, 10 and 11), which, because of its electrical connection with motor 142 by wiring shown in the accompanying figures, de-energizes motor 142. Because the one-way bearing 153 does not allow rearward movement of shaft 152, or in the case of FIGS. 2 and 3, counterclockwise movement, shaft 152 is not pulled rearwardly, or counterclockwise, by spring 160. Also, because limit switch 170 is positioned such that arm 154 has not yet reached the approximately 12 o'clock position, i.e., a position where arm 154, arm 158, and spring 160 are essentially co-linear, the spring 160 does not pull the arm 154 in the clockwise direction. FIG. 4 illustrates arm 154 at or near the 6 o'clock position, wherein spring 160 in a less-tensioned configuration as compared to the tension in spring 160 when arm 154 is at or near the 12 o'clock position. FIG. 6 also illustrates spring 160 in a tensioned configuration.

When the motor 142 is de-energized by arm 154 contacting limit switch 170, the launching member, or arm, 120 is generally in the position as shown FIG. 5, positioned rearwardly of the target disk 102. Upon the operator re-energizing activating a control (not shown) to override the limit switch 170, motor 142 again begins to turn, and launching arm 120 advances somewhat slowly to contact target disk 102, and once arm 154 goes beyond the 12 o'clock position, spring 160 takes over, which immediately impels the target disk from track 118. Motor 142 then continues to rotate arm 120 until it returns back to the position shown in FIG. 5, and arm 120 is automatically cocked, or armed, ready to impel the next target disc. Note that this is because arm 120, when rotated again by motor 142, will automatically stop once again when it contacts limit switch 170.

This configuration thus allows for a relatively soft contact and start of a disk 102 along track 118 before the impulse force caused by spring 160 taking over to rapidly deploy arm 120, and consequently, launching target disk 102. Such a configuration is anticipated to likely reduce the incident of target discs breaking due to an inordinate impulse force being initially applied upon a disk via contact of a launching mechanism.

System 100 can be partially disassembled for facilitating transport, wherein wingnuts 180 (FIG. 15) can be removed to remove track 118 from launching structure 114. Similarly, to reduce the profile of system 100 during transport, launching member 120 can be removed from launching structure 114 by removal of pivot 182. Additionally, should it be desirable to adjust the radius of launching member 120, pivot 182 (which extends though one of the holes 184 in launching member 120) can be moved to another of holes 184 in launching member 120.

From the foregoing, it can be seen that system 100, as a single device disclosed in various versions of implementations herein, is a capable of launching target disks of at least five different types, namely, standard target disks 102*a* (FIG. 17A), midi target disks 102*b* (FIG. 17B), mini target disks 102*c* (FIG. 17C), battue target disks 102*d* (FIG. 17D), and rabbit target disks 102*e* (FIG. 5). It is to be understood, however, that system 100 is not limited to such five disk styles and could be used to launch target disks, or other disk-shaped objects, if desired. Moreover, system 100 as a single device disclosed in various versions of implementations herein, is capable of presenting target disks and other objects in horizontal and vertical positions (and intesinediate positions between the horizontal and vertical positions) and also with variations in angle and attitudes as well as altitude of track 118. Further, via the interaction between shaft 123 and sleeve 127, the first support allows the launching structure to produce virtually a myriad of desired presentations of a target desired from a single secured base launching platform, namely, support 104, which may also be rotated 360 degrees.

Many modifications and other examples of the disclosure set forth herein will come to mind to those skilled in the art to which this disclosure pertains, having the benefit of the teachings presented in the foregoing descriptions and the associated drawings. Therefore, it is to be understood that the disclosure is not to be limited to the specific examples disclosed and that modifications and other embodiments are intended to be included within the scope of the appended claims.

Moreover, although the foregoing descriptions and the associated drawings describe aspects of the disclosure in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific tends are employed herein, they are used in a generic and descriptive sense only and not for purposes of limitation.

What is claimed is:

1. A system for launching a target disk above a terrestrial surface, the system comprising:

a first support;

a first bracket attached to the first support;

a second support connected to the first bracket and configured to pivot with respect to the first bracket in a first plane;

a second bracket attached to the second support, and the second support configured to pivot with respect to the second bracket in a second plane, the second plane being generally perpendicular to the first plane;

a launching structure attached to the second bracket and configured to pivot with the second bracket;

an elongated track provided on the launching structure and configured to hold the target disk and to direct the target disk upon launching of the target disk; the track being configurable to present the target disk to be launched in a first presentation generally parallel to the terrestrial surface and a second presentation generally perpendicular to the terrestrial surface;

a launching member connected to the launching structure that selectively contacts the target disk to launch the target disk from the track; and an impulse force device connected to the launching structure that selectively impels the launching member to contact and launch the target disk from the track.

2. The system of claim 1, wherein the first bracket is configured rotate substantially 360 degrees with respect to the first support.

3. The system of claim 1, further comprising:

the impulse force device including:

a motor;

a shaft connected to the motor for rotation by the motor;

the launching member being connected to the shaft for rotation with the shaft, the launching member being movable between a disarmed position and an at tried position;

a one-way bearing adapted to receive the shaft and to allow the shaft to rotate in only one direction;

a first arm attached to the shaft;

a second arm attached to the first arm and configured to pivot with respect to the first arm;

a spring connected to the second arm; and a limit switch connected to the motor and configured to de-energize the motor upon the first arm rotating into proximity with the limit switch, wherein the spring is in tension against the second arm, and the launching member is in the armed position; and wherein, upon re-energization of the motor, the launching member is first rotated by the motor and then moves substantially under a force of the spring acting through the second arm, the first arm, and the shaft to impel and launch the target.

4. The system of claim 1, further comprising:

the first bracket defining one or more arcuately-extending or arcuately-arranged holes;

the second support has at least one retainer hole; and a retainer selectively engaging at least one of the arcuately-arranged holes and the retainer hole selectively fixing the second support to the first bracket.

5. The system of claim 1, further comprising:

the second bracket defining one or more arcuately-extending or arcuately-arranged holes;

the second support has at least one retainer hole; and a retainer selectively engaging at least one of the arcuately-arranged holes and the retainer hole selectively fixing the second support to the second bracket.

6. The system of claim 1, further comprising:

the first support including a shaft having a generally cylindrical exterior portion;

a sleeve configured to receive the shaft and for allowing the shaft to be rotated with respect to the sleeve and to be moved upwardly and downwardly with respect to the sleeve; and an adjustable retainer configured to allow selective releasably fixation of the shaft with respect to the sleeve.

7. The system of claim 1, wherein the track is configurable to be angled between substantially any angular orientation between the first orientation and the second orientation.

8. The system of claim 1, further comprising a retainer selectively releasably attachable to the launching member, wherein upon the retainer being attached to the launching member, the retainer configured to retain the target disk on the track prior to launching of the target disk.

9. The system of claim 8, wherein the launching structure and the track are configured to accommodate and launch without additional components standard target disks, midi target disks, mini target disks, battue target disks, and rabbit target disks.

10. The system of claim 1, further comprising a resilient material positioned on the track configured to introduce resistance to the target disk to induce rotation of the disk upon the launching of the disk from the track.

11. The system of claim 10, further comprising:

the impulse force device including a tensioning spring; and a threaded anchor connected to the tensioning spring and the launching structure, wherein rotation of the threading anchor adjusts a tension in the tensioning spring and a force by which the impulse force device impels the launching member to contact and launch the target disk.

12. A method for launching a target disk above a terrestrial surface, the method comprising:

providing a first support, a first bracket attached to the first support, and a second support connected to the first bracket, the first support being configured to pivot in a first plane with respect to the first bracket;

providing a second bracket and a launching structure, the second bracket being attached to the launching structure and to the second support, the launching structure being configured to pivot with respect to the second bracket in a second plane, the second plane being generally perpendicular to the first plane;

providing an elongated track provided on the launching structure;

manipulating the track to present the target disk to be launched in a first presentation generally parallel to the terrestrial surface;

manipulating the track to present the target disk to be launched in a first presentation generally perpendicular to the terrestrial surface;

providing a launching member connected to the launching structure configured to selectively contact the target disk to launch the target disk from the track;

providing an impulse force device connected to the launching structure that, upon activation, selectively impels the launching member to contact and launch the target disk from the track;

placing the target disk on the track; and activating the impulse force device such that the impulse device impels the launching member to contact and launch the target disk from the track.

13. The method of claim 12, further comprising rotating the first bracket through an arc with respect to the first support.

14. The method of claim 12, further comprising:

rotating the second support through an are with respect to the first bracket; and selectively fixing the second support to the first bracket.

15. The method of claim 12, further comprising:

rotating the launch structure through an arc with respect to the second bracket; and selectively fixing the launch structure to the second bracket.

16. The method of claim 12, further comprising attaching a retainer to the launching member configured to retain the target disk on the track prior to launching of the target disk.

17. The method of claim 16, wherein the placing of the target disk on the track and launching the target disk from the track includes placing and launching, one at a time and in no particular order, a standard target disk, a midi target disk, a mini target disk, a battue target disk, and a rabbit target disk.

18. The method of claim 12, further comprising:

providing a tensioning spring connected to the impulse force device and a threaded anchor connected to the tensioning spring and the launching structure; and rotating the threading anchor to adjust a tension in the tensioning spring and a force by which the impulse force device impels the launching member to contact and launch the target disk.

19. A system for launching a target disk above a terrestrial surface, the apparatus comprising:

a first support;

a first bracket attached to the first support;

a second support connected to the first bracket and configured to pivot with respect to the first bracket in a first plane;

a second bracket attached to the second support, and the second support being configured to pivot with respect to the second bracket in a second plane, the second plane being generally perpendicular to the first plane;

a launching structure attached to the second bracket and configured to pivot with the second bracket;

an elongated track provided on the launching structure and configured to hold the target disk and to direct the target disk upon launching of the target disk; the track being configurable to present the target disk to be launched in a first presentation generally parallel to the terrestrial surface and a second presentation generally perpendicular to the terrestrial surface; the track being configurable to be angled in substantially any angular orientation between the first orientation and the second orientation;

a launching member connected to the launching structure that selectively contacts the target disk to launch the target disk from the track;

an impulse force device connected to the launching structure that selectively impels the launching member to contact and launch the target disk from the track;

the first bracket defining a plurality of arcuately-arranged first bracket holes;

the second support defining at least one first bracket retainer hole;

a first retainer selectively engaging at least one of the arcuately-arranged first bracket holes and the first retainer hole selectively fixing the second support to the first bracket;

the second bracket defining a plurality of arcuately-arranged second bracket holes;

the second support defining at least one second bracket retainer hole;

a second retainer selectively engaging at least one of the arcuately-arranged second bracket holes and the second bracket retainer hole selectively fixing the second support to the second bracket;

a retainer selectively releasably attachable to the launching member, wherein upon the retainer being attached to the launching member, the retainer retains the target disk on the track prior to launching of the target disk; and wherein, the launching structure and the track are configured to accommodate and launch without additional components standard target disks, midi target disks, mini target disks, battue target disks, and rabbit target disks.

* * * * *